United States Patent [19]

Levene

[11] Patent Number: 5,065,420

[45] Date of Patent: Nov. 12, 1991

[54] ARRANGEMENT FOR CONTROLLING FOCAL SPOT POSITION IN X-RAY TUBE

[75] Inventor: Simha Levene, Dorna Hadarom, Israel

[73] Assignee: Elscint Ltd., Haifa, Israel

[21] Appl. No.: 550,617

[22] Filed: Jul. 10, 1990

[30] Foreign Application Priority Data

Jul. 26, 1989 [IL] Israel ..... 091119

[51] Int. Cl.[5] ..... H01J 35/30

[52] U.S. Cl. ..... 378/137; 378/121; 378/136

[58] Field of Search ..... 378/136, 137, 138, 119, 378/121, 125, 134

[56] References Cited

U.S. PATENT DOCUMENTS

| | | | |
|---|---|---|---|
| 4,689,809 | 8/1987 | Sohval . | |
| 4,748,650 | 5/1988 | Ammaun | 378/138 |
| 4,819,260 | 4/1989 | Haberrecker . | |
| 4,827,494 | 5/1989 | Koenigsberg | 378/137 |

*Primary Examiner*—Edward P. Westin
*Assistant Examiner*—David P. Porta
*Attorney, Agent, or Firm*—Sandler, Greenblum & Bernstein

[57] ABSTRACT

Using electrostatic forces for controlling the location of the focal spot of the electron beam on the anode of an X-ray tube, the location is determined by a pair of detectors.

6 Claims, 2 Drawing Sheets

ARRANGEMENT FOR CONTROLLING FOCAL SPOT POSITION IN X-RAY TUBE

FIELD OF THE INVENTION

The present invention relates to X-ray tubes and more particularly to X-ray tubes that include means for controlling the location of the focal spot of the electron beam on an anode.

BACKGROUND OF THE INVENTION

Prior art X-ray tubes wherein the location of the focal spot on the anode is controlled, includes the tube described in U.S. Pat. No. 4,689,809 assigned to the Assignee of the present invention. Therein the focal spot is controlled and located successively at two different locations. That X-ray tube with the dual focal spot location is particularly useful in computerized tomographic scanners since it effectively doubles the number of X-ray beams used during the scan thereby increasing the resolution.

One of the problems with X-ray tubes, especially those used in computerized tomographic scanners, is that external forces act on the electron stream coming from the cathode of the X-ray tube and terminating at the focal spot on the anode of the X-ray. Thus, for example, the stream of electrons themselves generate a magnetic field. The magnetic field of the stream of electrons is influenced by the earth's magnetic field as the X-ray tube on the rotor of the CT tomographic scanner rotates about the patient. The earth's magnetic field causes a perceptible deflection of the position of the focal spot on the anode during the rotation of the X-ray tube.

All uncontrolled changes in position of the focal spot on the anode are highly undesirable in computerized tomography wherein the position of the radiation source is part of the basic algorithm for processing the data to obtain the image. Many times CT systems are proximate to magnetic resonance imaging (MRS) equipment. Stray magnetic fields from the MRI equipment may also cause variations in the location of the focal spot.

In addition to the migration of the focal spot due to external magnetic fields, the migration of the focal spot in conventional X-ray tubes occurs for other reasons such as thermal expansion of components of the tube during operation and/or due to vibrations of the tube components induced by the mechanical rotation of the anode of the X-ray tube. Also, during the life of the X-ray tube, which may extend to over 100,000 scans (exposures) the cathode structure may move slightly from its original position, or the elements of the cathode structure may move slightly with respect to each other. The location of the focal spot is also adversely influenced by thin films which often form on the surfaces in the tube causing drift of the focal spot position.

The above mentioned U.S. patent does not provide a solution to the problems caused by the movement of the focal spot. Rather it provides dual focal spots each of which may migrate or be deflected for the reasons noted immediately hereinabove.

A U.S. Pat. No. 4,819,260 provides a system for controlling the location of the focal spot to maintain that location stationary. However, in that patent a detector at the edge of the X-ray beam is used to determine movement of the focal spot. In addition the control of the focal spot is accomplished magnetically. Having a detector at the edge of the X-ray beam is limiting. One of the problems inherent to the magnetic control of the focal spot is that it becomes necessary to use non-magnetic material in manufacturing the cathode head and the anode.

Another problem with the magnetic field control of the location of the focal spot is that a relatively large coil has to be attached externally to the tube. This increases the size and the cost of an already expensive and relatively large item in the CT scanner.

A BRIEF DESCRIPTION OF THE INVENTION

Accordingly, it is an object of the present invention to provide new and efficient means for controlling the location of the focal spot to maintain the focal spot in a "fixed" position in X-ray tubes and particularly those X-ray tubes used in computerized tomography. The focal spot location is determined using a pair of detectors. A first of said detectors is only partially illuminated by the X-ray beam. Any movement of the focal spot changes the portion of the detector that is illuminated. The partial illumination is accomplished either by positioning the detector at the edge of the X-ray beam or by shielding the detector within the X-ray beam so that only a portion of the detector is illuminated. A second detector is fully illuminated regardless of focal spot movement. The second detector serves as a reference detector.

The means in a preferred embodiment is particularly suitable for X-ray tubes whose focusing is accomplished by electro-static, rather than electro-magnetic, means.

In accordance with a preferred aspect of the present invention an X-ray tube control arrangement is provided, said tube arrangement comprising:

an X-ray tube envelope, cathode means disposed within the envelope, said cathode means including filament means for causing electrons to be emitted, anode means disposed within the envelope including an anode dish spaced apart from and facing said cathode means, bias voltage means for causing said emitted electrons to form an electron stream to flow from said cathode means and impinge upon said anode dish at a focal spot having a location on the anode dish, X-ray beam emanating from said focal spot, and electro-static means operated responsive to changes in the location of the focal spot for returning the focal spot to the location to thereby maintain the focal spot at a fixed location.

Another feature of the present invention includes means for detecting changes in the location of the focal spot on the anode dish relative to said cathode, for example.

A further feature of the invention includes detector means located, for example, at one side of the X-ray beam so that migration or deflection of the X-ray beam changes the amount of the X-rays illuminating the detector means. A characteristic of the detector means varies as a function of the amount of the X-ray beams striking the detector. For example, in one preferred embodiment the X-ray beam detector means is an electro-optical device that changes its conductance as a function of the area of the detector that is illuminated by the X-ray beam. The changed characteristics are then used to generate control signals to control a high voltage control unit (HVCU) of the X-ray power supply to vary the voltage on the grid or cathode so as to return the focal spot to its original desired location.

In another preferred embodiment of the present invention, the said detector means comprises a pair of detectors, one of said pair of detectors being a reference detector which is fully illuminated by the X-ray beam, the second of said pair of detectors being an X-ray beam position detector that is mounted either at the edge of the beam or is shielded so that any movement in the focal spot location changes the area of the detector illuminated by the X-ray beam. An illumination ratio comparison circuit determines whether the focal spot has moved. When the focal spot has moved, then an error signal is generated by the ratio comparison circuit. The error signal is fed back into the HVCU to move the focal spot back to its original position.

According to another aspect of the present invention the anode is a rotary anode.

According to yet another aspect of the present invention an independent location control signal can be fed into the high voltage control unit to control the focal spot so as, for example, to provide a dual focal spot.

Thus, the inventive system includes a feed-back arrangement for maintaining the original location of the focal spot. Any movement of the focal spot generates an error signal which is used to reposition the focal spot to its original location.

A BRIEF DESCRIPTION OF THE DRAWINGS

The above mentioned and other objects and features of the present invention will be best understood when considered in the light of the following description of a preferred aspect of the present invention made in conjunction with the accompanying drawings, wherein.

GENERAL DESCRIPTION

Figure 1:
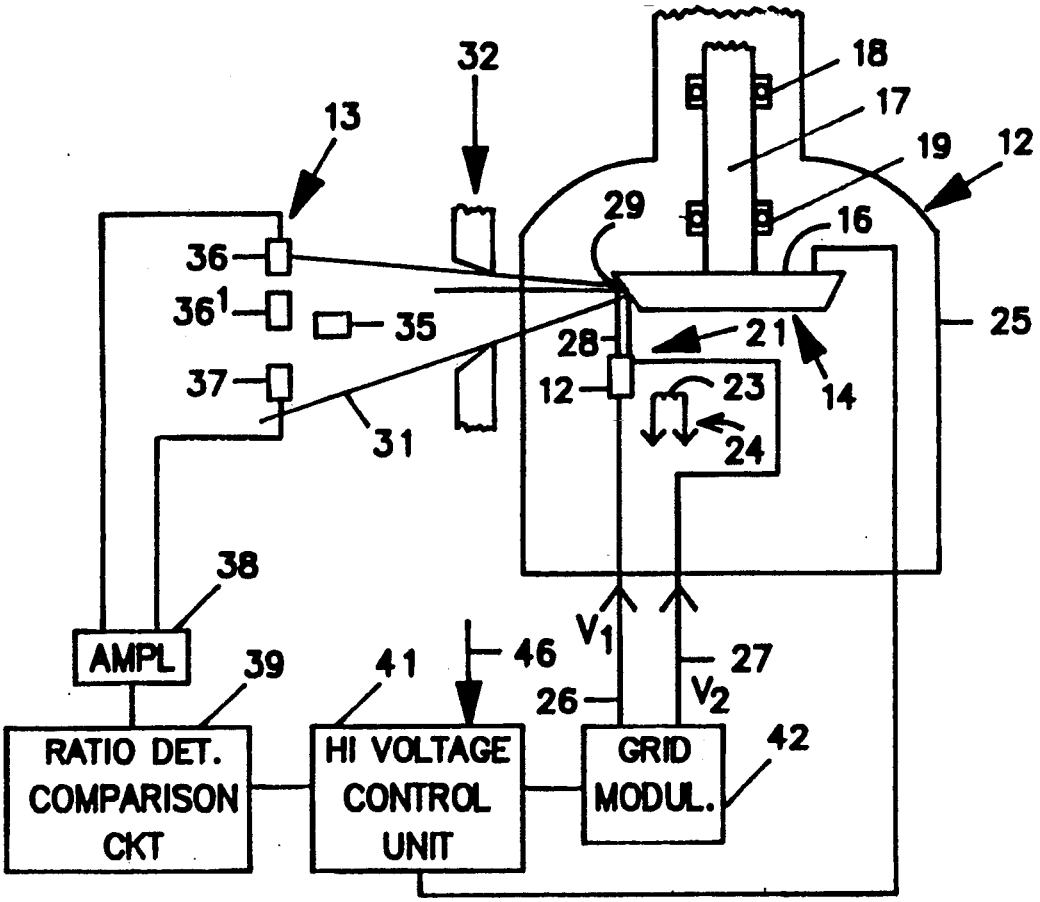
FIG. 1 is a schematic showing of the inventive X-ray tube arrangement including means for controlling the location of the focal spot.

FIG. 1 at 11 shows an X-ray tube arrangement featuring the ability to control the location of the focal spot on the anode. More particularly, the X-ray tube arrangement is shown as being comprised of an X-ray tube 12 and a focal spot location control arrangement 13. The X-ray tube 12 in a preferred embodiment is a rotating anode type X-ray tube. The anode assembly 14 comprises an anode dish 16 connected to a shaft 17 that is in turn connected to a motor not shown. Ball bearing means are indicated at 18 and 19, for example, for facilitating the rotation of the anode 14. The anode is spaced apart from and oppositely disposed from a cathode assembly 21. The cathode of the assembly includes a grid or cathode head 22 and a filament 23 in addition to conductors such as the conductors terminating in arrows 24 indicating the connection of the filament 23 to an appropriate power source. Both the cathode and anode are located within an envelope 25.

Two conductors 26, 27 are shown connecting the cathode 22 to a voltage source.

Figure 3:
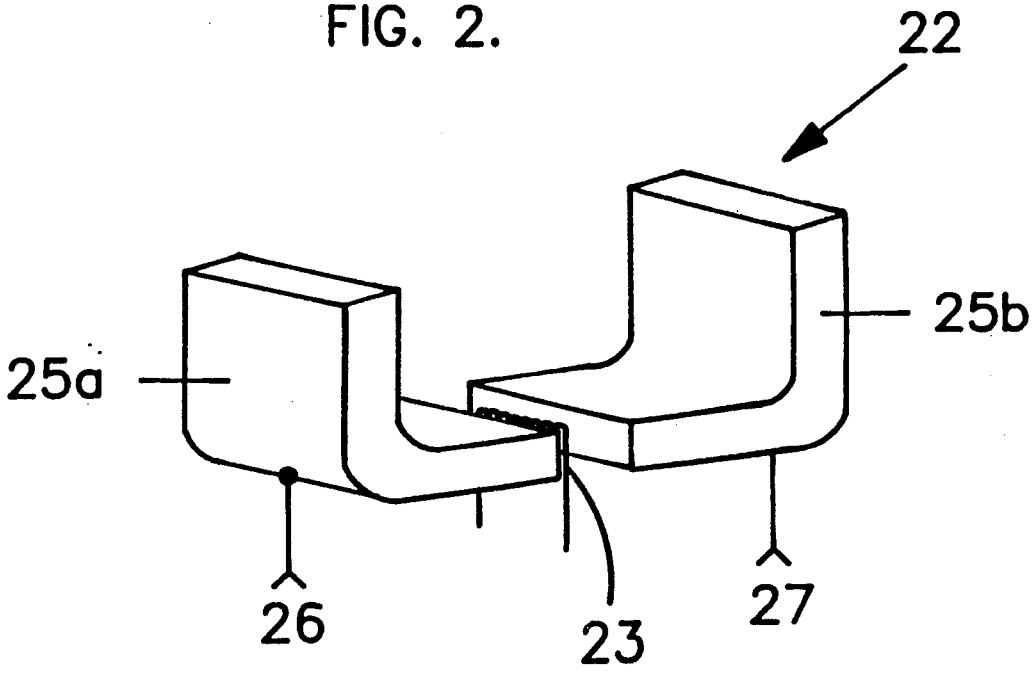
FIG. 3 is a pictorial showing of the cathode in one preferred embodiment of the present invention.

In a preferred embodiment, shown in particular in FIG. 3 a split cup cathode (25*a*, 25*b*) is used and each of the lines 26 and 27 connect a different section of the split cup cathode to voltage sources external to the X-ray tube.

While a split cathode is shown, other types of control means can be used for electro-statically controlling the location of the focal spot on the anode disk 16. For example, a deflection plate arrangement can also be used. However, a preferred embodiment utilizes the split cathode arrangement such as that shown in the aforementioned U.S. Pat. No. 4,689,809.

The cathode is biased relative to the anode (see FIG. 4) to cause a stream of electrons 28 to flow from the cathode 22 and strike the anode dish 16 at a focal spot 29. Responsive to the electrons striking the anode, an X-ray beam 31 is emitted from the anode in a well known manner. The X-ray beam 31 is shown delineated by a collimator 32.

The beam position control arrangement 13 is provided for controlling the location of the focal spot 29 on the anode dish 16. As shown in FIG. 1, the beam position control arrangement comprises a beam position detector 36 located at the edge of the X-ray beam 31 so that only a fraction of the beam position detector is illuminated by the X-ray beam. Alternatively, the detector 36 could be located well within the beam as shown at 36' but behind a shield 35. The fraction of detector 36' illuminated by the X-ray beam varies as a direct function of the focal spot location.

The beam position control arrangement, in a preferred embodiment also includes a reference detector 37 which is positioned to be fully illuminated by the X-ray beam 31. When the focal spot 29 moves then the area of the beam position detector 36 (or 36') that is partially illuminated by the X-ray beam changes either positively or negatively, but the illuminated area of the reference detector does not change.

The output of the beam position detector 36 and the reference detector 37 are both transmitted to amplifiers indicated at block 38. The amplifiers amplify the signals from the detector means. The amplified signals from the detector means are transmitted to a ratio detector and comparison circuit 39. The ratio detector and comparison circuit 39 determines the original ratio of the output of the beam position detector and the output of the reference detector and the present ratio of the output of the beam position detector and the output of the reference detector and compares the outputs to determine any change in position of the X-ray beam. Any change in position causes ratio detector and comparison circuit 39 to generate an error signal at its output. Thus, the comparison unit preferably includes a memory, not shown, that stores the original ratio of the output of the beam position detector to the reference detector. The change from that initial ratio results in the error signal, that is either positive or negative.

The error signal is provided to HVCU 41 to provide a signal change at the output of the HVCU, which changes the output of the grid modulator circuit 42. The output of the grid modulator circuit 42 is changed in a manner to cause the focal spot to return to its initial position.

In a preferred embodiment the HVCU is a "computer", which controls an output from the grid modulator that will cause the focal spot to be returned to its original location when the focal spot moves responsive to either changes in the surrounding magnetic field or changes in the geometry of the tube due to changes in temperature or other environmental changes, or to geometrical changes in the relative positions of the elements within the X-ray tube; or to surface coatings upon those elements which change the position of the focal spot.

A preferred embodiment enables the input of independent location control signals to the HVCU to cause the focal spot to move when it is desired to independently control the locale of the focal spot. Thus, the focal spot location can be controlled to provide a dual focal spot function of the tube with the circuitry of FIG. 1. The independent location control signal is shown being input to the HVCU at 46. The output voltage of the grid modulator; i.e., voltages V1 and V2 are carried by conductors 26 and 27 which are coupled to each of the two halves of the cathode or to the cathode and a deflector plate, for example.

Figure 2:
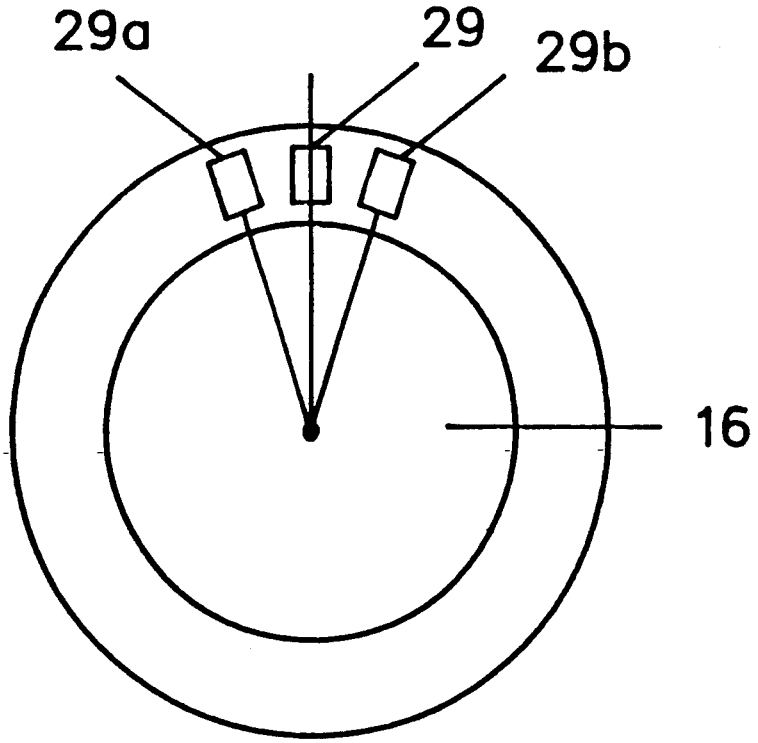
FIG. 2 is a plan view of the anode of the X-ray tube showing the type of focal spot movement that the present invention corrects.

The showing of FIG. 2 is an exaggerated showing of how the position of the focal spot 29 may vary laterally (circumferentially). Thus, the focal spot is shown generally as having a rectangular shape with its longitudinal dimension being in the radial direction relative to the anode and its shorter side being lateral to the radial direction; i.e., tangential. The control voltage applied by the inventive electro-static means controls the circumferential positioning of the focal spot. The focal spot may have been moved by external forces either to position 29*a* or position 29*b* laterally from the original location of the focal spot 29. The outputs of the grid modulator on lines 26 and 27 are designed to return the focal spot to the original position shown at 29 in FIG. 2.

FIG. 3 shows the cathode head 22 being of the split-cup-cathode variety. Herein the cathode has a section 25*a* split from the section 25*b*. The biasing voltage V1 of the conductor 26 is connected to the cathode section 25*a*. The conductor 27 connects the biasing voltage V2 for the cathode to section 25*b*. Controlling the voltages V1 and V2 on conductors 26 and 27 enables controlling the lateral location of the focal spot 29.

The filament 23 is shown located between the two sections of the cathode 22. When the filament has current therethrough it heats up and a stream of electrons 28 strikes the anode dish 16 at the focal point. The impingement of the electrons generates an X-ray beam. The bias voltages on the split cathode control the location and size of the focal spot by controlling the electron stream. Thus, when both cathode parts 25*a*, 25*b* are sufficiently negative, the electron stream is cut-off and consequently the X-ray beam is turned off. If one part of the cathode is more negative than the other, for example, if part 25*a*, is more negative than part 25*b*, then the focal spot moves away from the more negative part; i.e., to focal spot 29*b* in FIGS. 2 and 4.

Figure 4:
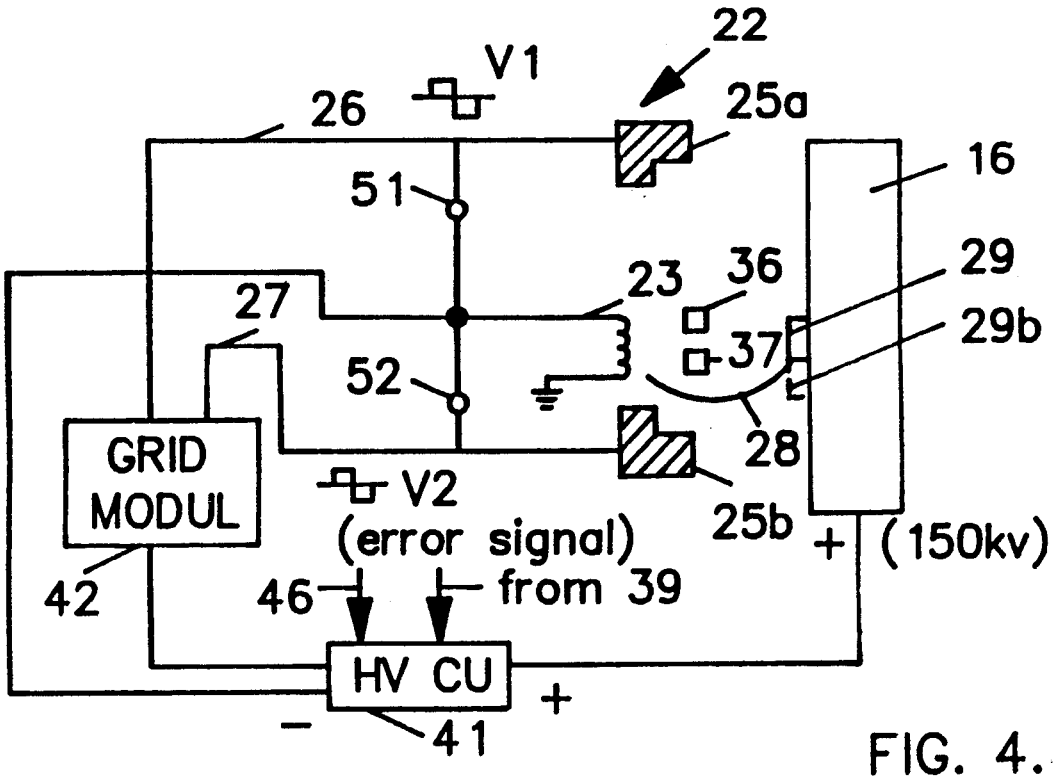
FIG. 4 is a block diagram showing of details of the control of the focal spot according to one aspect of the present invention.

FIG. 4 shows control circuitry for maintaining the focal spot at a fixed location. The HVCU 41 normally maintains the anode at a high positive voltage relative to the cathode, for example, 150 KV in one preferred embodiment. The split sections 25*a*, 25*b* of cathode cup 22 are normally maintained at the same voltage. The biasing is indicated by voltage bias units 51, 52 for biasing cup section 25*a*, 25*b* respectively. When the focal spot moves, an error voltage is generated that effectively changes the bias on the cup sections by applying voltages V1 and V2 with the relative values of voltages V1 and V2 causing the focal spot to return to its original location. For example, if the focal spot was moved to location 29*b* by the earth's magnetic field, then the error signal would cause V2 to be sufficiently negative relative to V1 so as to return the focal spot to its original location.

In operation, power is supplied to filament 23 and operating voltages are applied to the cathode sections and to the anode. A stream of electrons 28 is emitted by the cathode to a position on the anode controlled by the relative voltages V1 and V2. If subsequently, the location of the focal spot changes, the detector means comprising the beam position detector and reference detector measure the movement of the focal spot. The ratio and comparison circuit 39 provides an error signal to the HVCU unit 41 that in turn causes the grid modulator to vary the voltages applied to the cathode section to return the focal spot to its original position. Thus, if the focal spot moves upward in FIG. 4 the voltage V1 would be made more negative than the voltage V2 to force the focal spot to return to its original position.

Alternatively, the focal spot can be moved independently by an independent control signal. When the dual focal spot option for the tube is being used then two focal spot location means are used to control the location of the dual focal spots. Clearly, the voltages required for focal position stabilization can be superimposed upon those required for independent movement of the focal spot position so that the dual focal spots are maintained about their original positions.

While a reference detector has been described it should be understood that the system can work with only the position detector. The reference detector is used in a preferred embodiment to increase the accuracy of the system. Without the reference detector, for example, higher energy X-rays could cause an erroneous position change.

While the invention has been described with relation to certain preferred embodiments, it should be understood that the description thereof is made by way of example only and not as a limitation on the scope of the invention.

What is claimed is:

1. An X-ray tube arrangement comprising:

an X-ray tube envelope, cathode means disposed within the envelope, said cathode means including filament means for causing the emission of electrons, said cathode means comprising a split cup including a first part and a second part, said first part and said second part being insulated from each other and being juxtaposed to and on opposite sides of said filament means, an anode dish means spaced apart from and facing said cathode means within said envelope, bias voltage means for causing said emitted electrons to form an electron stream flowing from said cathode means to an original focal spot location on the anode dish means, X-ray beams emanating from said focal spot, detector means for detecting changes in the focal spot location on the anode dish means, said detector means comprising:

a pair of electro-optical means, a first electro-optical means of said pair being located on the edge of said X-ray beams to detect any changes in the location of said focal spot by detecting changes in percentage of said first electro-optical means being illuminated by said X-ray beams, said second electro-optical means being located fully within said beams so that changes in the focal spot location do not change the percentage of illumination of said second electro-optical means, means for determining the ratio of illumination between said first and said second electro-optical means, a high voltage control unit (HVCU) for supplying biased voltages to said anode dish means relative to said cathode means, grid modulation means controlled by said HVCU for supplying biased voltages to said first cathode cup part and said second cathode cup part, and means responsive to changes in the ratio for providing an error signal to said HVCU to vary the bias voltages supplied to said first and said second cathode cup parts for electrostatically changing location of said focal spot to return said focal spot to said original location.

2. The X-ray tube arrangement of claim 1 including means for changing the voltages applied to said first and second parts to alternately generate first and second focal spots.

3. An X-ray tube arrangement comprising:

an X-ray tube envelope, cathode means disposed within the envelope, said cathode means including means for causing the emission of electrons, anode dish means spaced apart from and facing said cathode means within said envelope, bias voltage means for causing said emitted electrons to form an electron stream flowing from said cathode means to an original focal spot location on said anode dish means, an X-ray beam emanating from said focal spot, detector means located within said X-ray beam for detecting changes in the location of the focal spot on the anode dish means, said detector means being shielded from said X-ray beam so as to be only fractionally illuminated by said X-ray beam, and means operated responsive to changes in the location of the focal spot for returning the focal spot to said original location.

4. The X-ray tube arrangement of claim 3 wherein said detector means comprises:

a pair of detectors, a first detector of said pair of detectors being positioned so that any change in the location of the focal spot changes the percentage of illumination by said X-ray beam of said first detector, a second detector of said pair of detectors being located so that changes in the focal spot location do not change the percentage of illumination of said second detector means, means for determining the ratio of illumination between said first and said second detectors, and means responsive to changes in the ratio for providing an error signal for changing the location of said focal spot to return said focal spot to said original location.

5. The X-ray tube arrangement of claim 4 wherein said detector means comprise electro-optical means.

6. The X-ray tube arrangement of claim 3 wherein said cathode means comprises a split cup including a first and a second part, said first and said second parts being insulated from each other and being juxtaposed to and in opposite sides of said filament means.

* * * * *